US005667640A

United States Patent [19]

Wanke

[11] Patent Number: 5,667,640

[45] Date of Patent: Sep. 16, 1997

[54] TWO-WIRE FORMER FOR PAPER-MAKING MACHINES

[75] Inventor: Wilhelm Wanke, Heidenheim, Germany

[73] Assignee: J.M. Voith GmbH, Germany

[21] Appl. No.: 436,388

[22] PCT Filed: Sep. 22, 1994

[86] PCT No.: PCT/EP94/03164

§ 371 Date: May 17, 1995

§ 102(e) Date: May 17, 1995

[87] PCT Pub. No.: WO95/08669

PCT Pub. Date: Sep. 22, 1994

[30] Foreign Application Priority Data

Sep. 22, 1993 [DE] Germany ..... 43 32 162.3

[51] Int. Cl.[6] ..... D21F 1/00

[52] U.S. Cl. ..... 162/203; 162/213; 162/301

[58] Field of Search ..... 162/203, 300, 162/301, 352, 213

[56] References Cited

U.S. PATENT DOCUMENTS

| | | | |
|---|---|---|---|
| 4,557,802 | 12/1985 | Waris | 162/301 |
| 4,623,429 | 11/1986 | Tissari | 162/301 |
| 4,734,164 | 3/1988 | Irwin et al. | 162/352 |
| 5,074,966 | 12/1991 | Koivuranta | 162/301 |
| 5,203,967 | 4/1993 | Bando et al. | 162/301 |

FOREIGN PATENT DOCUMENTS

| | | |
|---|---|---|
| 0 335 821 | 10/1989 | European Pat. Off. . |
| 1925407 | 6/1970 | Germany . |
| 4332162 | 2/1994 | Germany . |
| WO91/02842 | 3/1991 | WIPO . |

*Primary Examiner*—Karen M. Hastings
*Attorney, Agent, or Firm*—Baker & Daniels

[57] ABSTRACT

A two-wire former for producing a web of fibrous material, in particular a paper web, is designed as a gap-former with the following characteristics: a first and a second wires form together a twin wire; a headbox injects the pulp directly between the two wires; at least one first dewatering zone consists in the advance direction of a curved, non-rotary, interrupted surface, for example, a forming shoe or several strips that form together a surface. The invention is characterized in that a convex dewatering element that starts directly at the point of impact of the jet of pulp is provided at the beginning of the first dewatering zone, seen in the advance direction, and has at least two curvature radii Ri in contact with the wires. Both curvature radii Ri are smaller than the curvature radius Ri+1 that follows them in the advance direction.

16 Claims, 4 Drawing Sheets

TWO-WIRE FORMER FOR PAPER-MAKING MACHINES

The invention concerns a double-wire former for a paper machine fashioned as a gap former and having a first and second wire jointly forming a double wire, a headbox which injects a suspension directly between the double wire and a first dewatering zone which, viewed in the machine direction, consists of a curved, nonrotating perforated surface, for example a forming shoe or a surface formed of several slats.

Double-wire formers for paper machines, notably so-called gap formers, are known in many styles. Reference is made to the following publications:

(1) WO 91/02842 describes a double-wire former which essentially contains a gap former and having a first and second wire jointly forming a double wire, a headbox which injects a suspension directly between the double wire and a first dewatering zone which, viewed in the machine direction, consists of a curved, nonrotating perforated surface, for example a forming shoe or a surface formed of several slats. Concerned here is a double-wire former fashioned as a gap former, where among others also an initial dewatering is being shown over a fixed forming box, albeit with a relatively slight curvature. The forming box has several dewatering slots, bounded by slats, across which pass the wires with the paper substance contained in between. Shown as an alternative is also an initial dewatering via a rotating forming roll which, e.g., may be designed as a suction roll.

(2) EP 0 335 821 A1 describes a variant of a double-wire former where an attempt is made at improving the congested conditions between headbox and wire gap to the effect that the top wire and the bottom wire are passed to the first dewatering zone, each across a fixed deflection element with a slight radius of curvature, attempting to reduce the high friction that occurs on the fixed deflection elements, between wire and deflection element, by way of an additional water spray introduction before the deflection element.

A disadvantage of the double-wire former illustrated in (1) is that one needs to choose either a double-wire former with a stationary forming box featuring several slats arranged successively in the direction of wire travel, said slats forming an initial dewatering zone with a very large radius of curvature, or a double-wire former with a rotating forming element situated in the initial dewatering zone and possessing a relatively small radius of curvature. If the choice is a fixed forming box, a paper with a good nonflaky formation is ultimately obtained, owing to the many slats, but with poorer basis weight profiles, because the wires tend with large radii of curvature to a wave formation transverse to the machine direction. When choosing a first forming element with a small radius of curvature, that is, a forming roll, a paper with improved basis weight profile is obtained, but deductions in terms of the formation of the paper are the trade-off.

Unfavorable with the double-wire former illustrated in (2) is its very high wire wear and particularly the necessity of a separate water spray introduction, in order to assure a lubrication between wire and fixed deflection elements. The forming box following the deflection elements has again a very large radius of curvature, with the result of a poor basis weight profile.

SUMMARY OF THE INVENTION

The problem underlying the invention is to propose a double-wire former that meets two requirements simultaneously. Namely, a paper is meant to be generated which has a very good, that is, maximally nonflaky formation, along with a maximally uniform basis weight profile. The latter should match the basis weight profile of a paper produced with the use of a forming roll as first dewatering element.

This problem is solved by providing at the start of the first dewatering zone, beginning directly at the point of jet impingement, a dewatering element of convex curvature which, when viewed in the machine direction, possesses at least two radii of curvature $R_i$ in contact with the wire, each radius of curvature $R_i$ being smaller than the radius of curvature $R_{i+1}$ which follows radius $R_i$ in the machine direction.

The inventor has recognized that the advantages of a double-wire former with a forming roll as a first dewatering element and the advantages of a double-wire former whose first dewatering element is a fixed forming box can be combined. When a forming roll is provided as a first dewatering element in a double-wire former, the result of the relatively small radius of curvature of the forming roll will be a clean and nonwavy contact of both double wires, due to existing wire tension, notably the tension of the wire opposite the forming roll. This excellent wire setup, in turn, makes for a very uniform cross profile of the paper web created. Disadvantageous, however, appears to be at the same time a reduction in the forming quality of the paper web. On the other hand, when making use of a fixed forming box with several slats for initial dewatering of the created paper web, said web displays very good and uniform formation properties, whereas the uniformity of the cross profile leaves much to be desired, since the wires tend to wave formation above the forming box.

The invention proposes to achieve the aforementioned positive properties simultaneously by, for one, waiving a rotating forming roll and, instead, providing a fixed forming box as a first dewatering element. Particular attention is devoted here to the initial area of the forming box, in a particular embodiment especially to the first dewatering slat. According to the invention, a tensioning of both wires is accomplished by giving at least the initial area of the forming box (on its approach side) a radius of curvature that matches only approximately that of a forming roll (in the order of 0.5 to 1.5 m). The following area then has normally a substantially larger radius of curvature. The said particular embodiment is characterized in that the first dewatering slat is fitted with at least two differently large radii of curvature, providing first for a heavy curvature with a radius of less than 1 m on which (as a further development of the invention) a chord path, in contact with the wire, of less than 100 mm is provided. Immediately following, on the same first slat, is a second section with a radius of curvature corresponding to the present prior art, i.e., with a radius ranging from 2 to 5 m. The jet of suspension is injected between the two wires in a way such that the point of impingement is located shortly before the front edge of the first dewatering slat, so that this first edge will strip about 10% of the wire water. From here on, the two wires continue to proceed along an equidirectional radius of curvature across the first dewatering slat, with the stock suspension contained between the wires. Obtained here, also for the "outer" wire, is a uniform tension across a curved surface, whereby a wave formation—and thus a disuniform basis weight profile—is avoided. The plurality of successively arranged slats—which, to avoid flaking, generate pressure pulses in the stock suspension—result at the same time in a good formation (i.e., good "transparency"). Accomplished is thus the desired combination of properties in the finished paper web. The immediate stripping of part of the wire water at the first approach edge effects at the same time a sufficient lubrication of the wire at that point, thereby avoiding wear of the wire surface and of the dewatering element.

Also within the scope of the invention is designing the first dewatering element in such a way that a continuous transition from a heavy curvature with a small radius of curvature to a shallow curvature with a large radius of curvature takes place. Given, similarly, is the option of substituting said first dewatering element with at least two radii of curvature by two or more successively situated separate dewatering elements with at least two different radii of curvature, with a dewatering gap provided between individual elements. The slats following the first dewatering element may be arranged on a further shallow radius of curvature curving in the same or opposite direction, or may be arranged also in a plane. The design of the following dewatering sections may correspond to the prior art.

BRIEF DESCRIPTION OF THE DRAWINGS

The invention will be more fully explained with the aid of the drawing, which shows.

Figure 1:
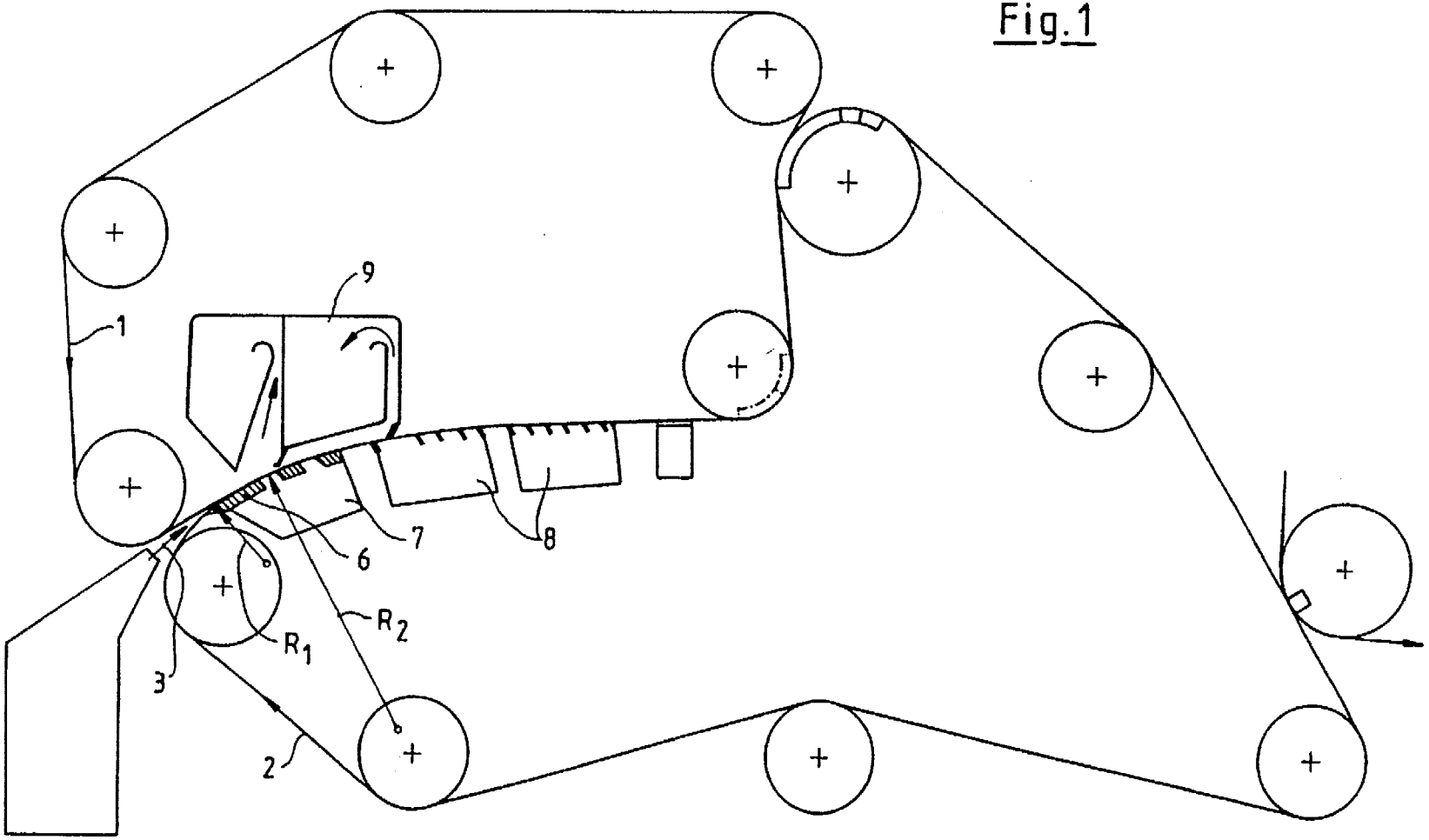
FIGS. 1 and 2, different double-wire formers in diagrammatic side elevation.
Figure 2:
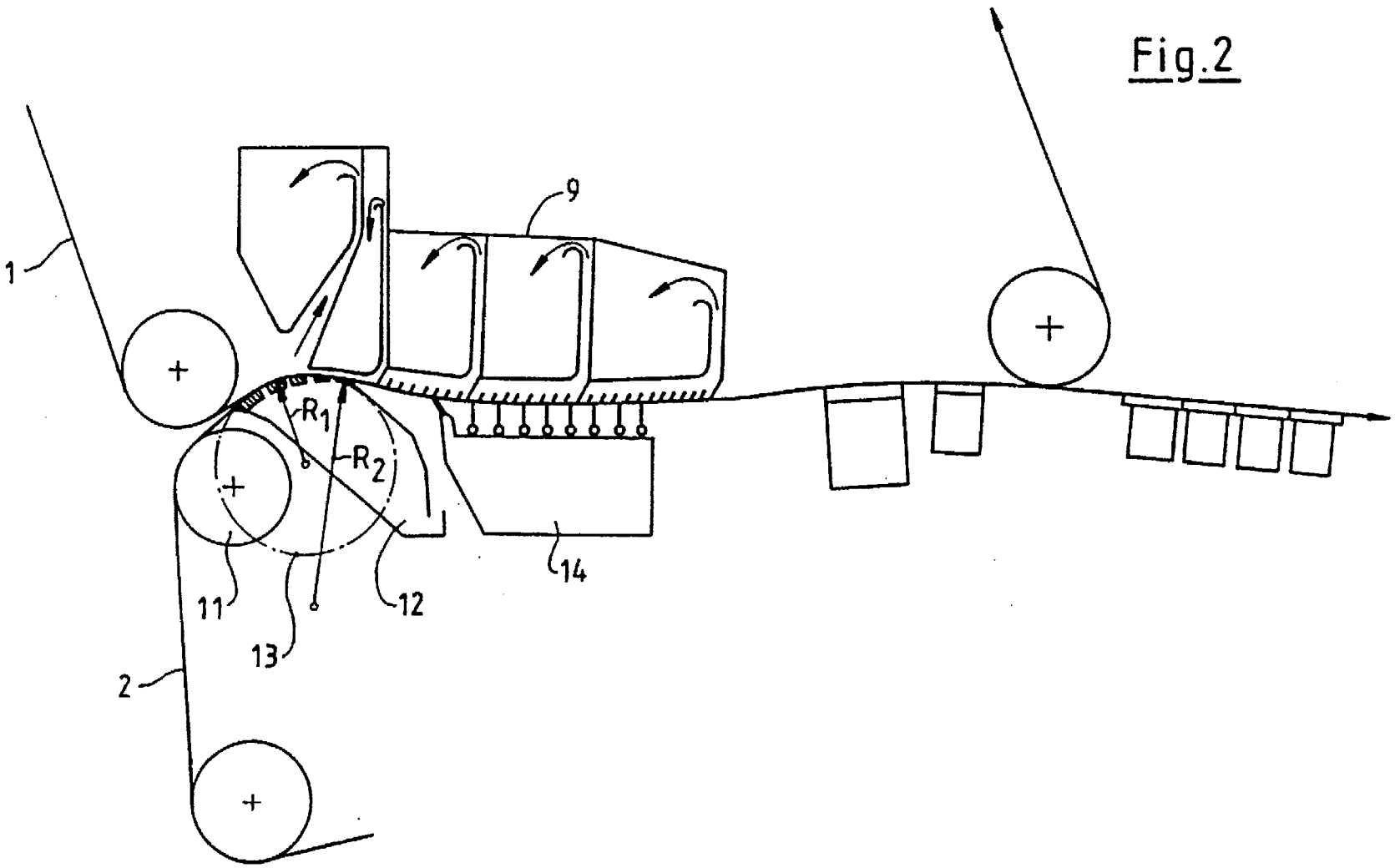

The two double-wire formers shown in FIGS. 1 and 2 feature each a revolving wire 1, 2. A headbox injects a machinewide suspension jet 3 into a wedge-shaped entrance gap formed by the two wires 1, 2.

In the embodiment according to FIG. 1, a first dewatering slat 6 is provided which is an integral part of a forming box 7. The arrangement of the dewatering slat is such that its front edge, viewed in the direction of wire travel, is situated directly at the point where the jet 3 impinges. The slat 6 has a convex curvature. The curvature changes in the direction of wire travel, and at that, it decreases; in other words: the radii of curvature increase.

The forming box 7 is followed by further dewatering boxes 8, which impart as well a convex curvature to the two wires 1 and 2. The radius of curvature of these two boxes equals approximately the last radius of curvature of forming boxes 7, namely $R_2$.

Contained in the loop of the wire 1—here the top wire—is a top wire suction box. It is subdivided by a partition, which is vertical here, so that the accruing water is split in two amounts right "at the source."

The embodiment according to FIG. 2 features at the start of the first dewatering zone a forming box 12 as a curved dewatering element. It is preceded by a bottom breast roll 11. The bottom breast roll 11 and the forming box 12 replace a forming roll 13, indicated by dashed line. The forming roll 13 would normally have a radius of $R_1$. Box 12 has several slats, and that, presently five. The slats carry the two wires 1, 2 again along a curved path. The curvature is convex. The radius of curvature amounts to $R_2$.

Regarding the design and arrangement of the said five slats, the following options are available:

Either all of the slats are situated on an arc with the radius $R_1$, or only the front, or first slats form an arc with the radius $R_1$, as illustrated, while the following slats form an arc with a larger radius $R_2$.

Forming box 12 is followed by a bank 14 of slats. The individual slats are mounted flexibly and can be pushed on the bottom wire 2 with adjustable force.

This embodiment, too, features again a top wire suction box. It possesses as well a plurality of slats and is fitted with several cross partitions for the separate collection of different wire water amounts. The design and arrangement of the slats of the top wire suction box and of the individual slats of the wire bank 14 is such that a curvature results that is directionally opposite to the curvature on box 12.

Figure 3:
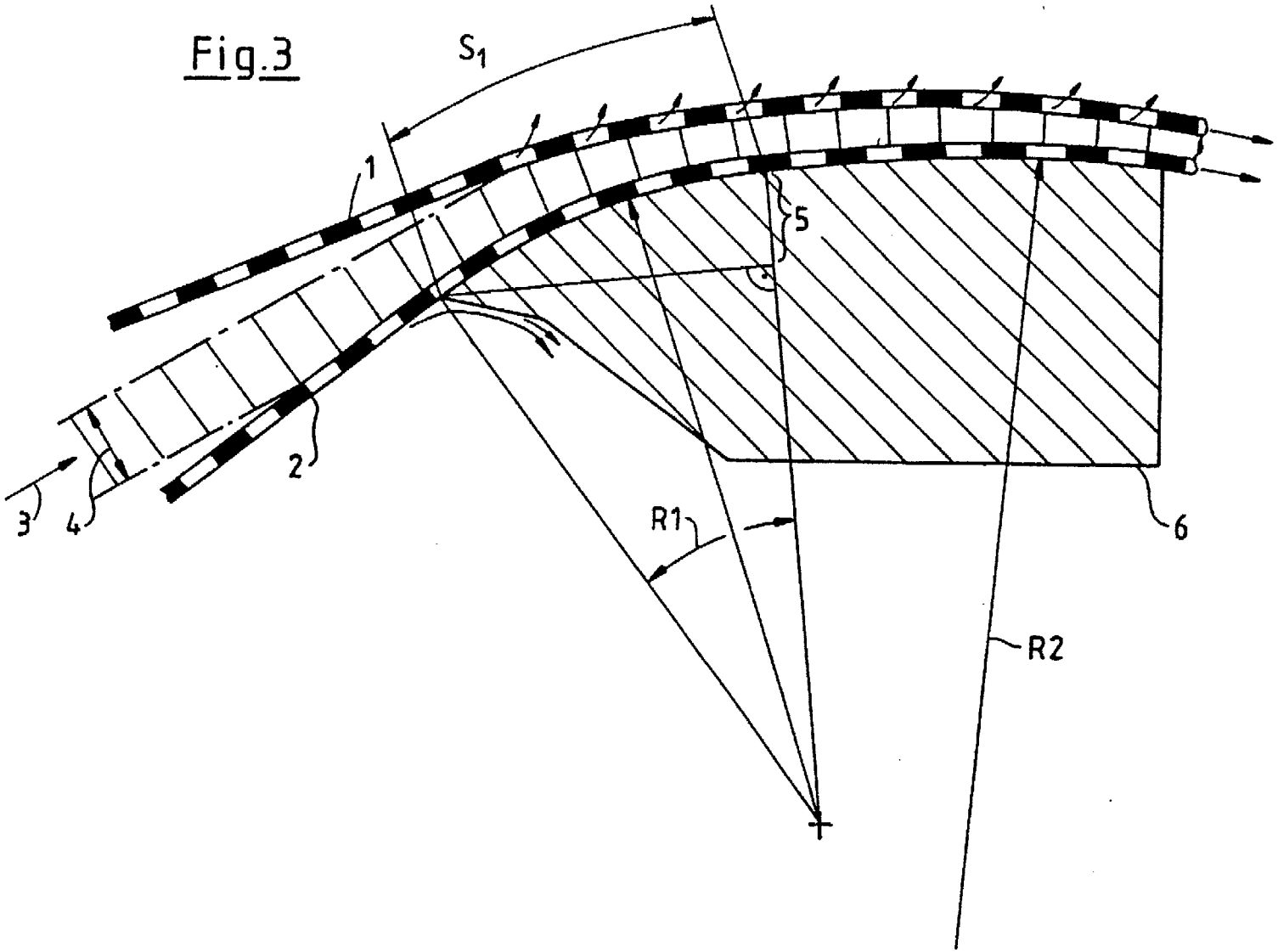
FIG. 3, a cross section through the first dewatering slat of the double-wire former illustrated in FIG. 1.

FIG. 3 shows a cross section of the first dewatering slat 6 of a forming box in the area of the point of jet impingement. Coming from the left, a top wire 1 and a bottom wire 2 are depicted, while the jet 3 with its jet thickness 4 impinges on the bottom wire in the area of the front edge of dewatering slat 6. The dewatering slat is depicted curved on its side facing the wire, with a curvature having a radius $R_1$ given at first, which in the further progression extends in a radius of curvature $R_2$ greater than the radius of curvature $R_1$. The chord height 5 above the radius of curvature $R_1$ is preferably greater than one-half the jet thickness 4 of the suspension jet 3. As can be seen in FIG. 3, a radial line intersecting the endpoint of the first curvature $R_1$ also intersects, at a right angle, a "chord line" drawn through the point at which curvature $R_1$ begins. The distance between these two points of intersection define the chord height 5 of the first curvature $R_1$. Inventionally, the design of top wire 1 is such that it makes contact with the suspension jet 3 as well in the area of the front edge of the first slat 6, preferably a short distance behind said front edge.

The smallest radius of curvature $R_1$ of the first dewatering element in contact with the wire may range between 100 and 1000 mm in some embodiments.

Other embodiments may have a first convex dewatering element wherein the radius provided at the start of the first dewatering element is less than 1000 mm and immediately following the first element at a free distance no greater than 100 mm is a second convex dewatering element with a radius greater than 2000 mm.

Lubrication between the wire and slat may be assured by arranging the first dewatering element such that the wire contacted, approach-side edge strips sufficient wire water.

Some embodiments may be configured such that $S_1 \leqq 100$ mm, where $S_1$ is the wire-contacted chord path above the area of the first dewatering element and $R \leqq 1000$ mm, where R is the radius of the first dewatering element for the wire-contacted chord path $S_1$.

Figure 4:
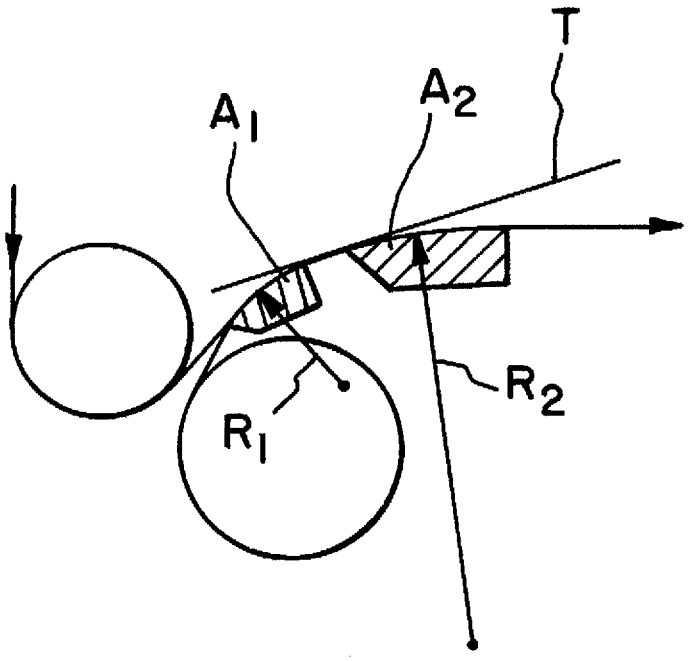
FIG. 4 is a cross section of a first dewatering element which has been divided into spaced apart sections.

In other embodiments, as shown in FIG. 4, the first dewatering element may be divided across the machine width in sections $A_i$ wherein section $A_i$ and immediately following section $A_{i+1}$ are separated. In between these sections the wire is unsupported. The tangent T of the leaving edge of section $A_i$ may coincide with the tangent of the approach edge of the following section $A_{i+1}$, as illustrated by sections $A_1$ and $A_2$ in FIG. 4.

A paper machine according to the present invention may also be configured such that the top wire defines, in cross section, a straight line from a point of departure of the top wire from a last deflection roll to a second point at which the top wire, in cross section, defines a curved line, wherein the second point is located in an angular sector ($S_1$ in FIG. 3) between a beginning point of a radius $R_{max}$, wherein $R_{max}$ is the largest radius $R_i$, and the first edge of radius $R_1$ as can be seen in FIG. 3. The last deflection roll from which the top wire departs prior to contacting the stock suspension is not shown in FIG. 3 but is illustrated in FIGS. 1 and 2.

I claim:

1. Double-wire gap former for the production of a fibrous paper web from a stock suspension, said double-wire former comprising:

a first wire and a second wire, said first and second wires jointly forming a double wire;

a headbox for producing a suspension jet directly between the first and second wires, the suspension jet contacting the second wire at a point of impingement; and a curved, nontotaling perforated surface having a first dewatering element with a first surface having a convex curvature, said first convex surface being in contact with said second wire, said contact beg at a first edge adjacent the point of impingement; said first convex surface having at least two radii of curvature $R_i$, wherein each radius of curvature $R_i$ satisfies the following equation:

$$R_i R_{i+1}$$

where $R_i$=a radius of curvature defining a convex surface comprising a first portion of said first convex surface;

$R_{i+1}$=a radius of curvature defining a convex surface comprising a second portion of said first convex surface immediately following radius of curvature $R_i$ in a direction of travel of the first and second wires; and $R_1$=a smallest radius of curvature of said first convex surface, said $R_1$ defining said first convex surface immediately following said first edge, said radius of curvature $R_1$ having a chord height which is greater than or equals one-half the thickness of the suspension jet, and $R_1 \leqq 1000$ mm.

2. Double-wire former according to claim 1 wherein $R_1$ is between 100 and 1000 mm.

3. Double-wire former according to claim 2 wherein the first dewatering element is disposed such that the first edge strips sufficient wire water to assure a lubrication between the second wire and the first surface.

4. Double-wire former according to claim 2, characterized in that the greatest wire-contacted radius of curvature of the first dewatering element is greater than 2000 mm.

5. Double-wire former according to claim 2, characterized in that the first dewatering element possesses exactly two radii of curvature $R_1$ and $R_2$.

6. Double-wire former according to claim 1, characterized in that the greatest wire-contacted radius of curvature of the first dewatering element is greater than 2000 mm.

7. Double-wire former according to claim 6, characterized in that the first dewatering element possesses exactly two radii of curvature $R_1$ and $R_2$.

8. Double-wire former according to claim 1, characterized in that the first dewatering element possesses exactly two radii of curvature $R_1$ and $R_2$.

9. Double-wire former according to claim 1 wherein the first dewatering element is disposed such that the first edge strips sufficient wire water to assure a lubrication between the second wire and the first surface.

10. Double-wire former according to claim 1 wherein the first radius of curvature $R_1$ defines a wire-contacted chord path $S_1$ along the first surface and $S_1 \leqq 100$ mm.

11. Double-wire former according to claim 1 wherein the first dewatering element comprises a plurality of sections, with said sections arranged with spaces therebetween, said spaces not providing wire support.

12. Double-wire former according to claim 11 wherein an individual section $A_1$ and an immediately following section $A_2$ are so arranged that a tangent on a leaving edge of the section $A_1$ coincides with a tangent of an approach edge of the following section $A_2$.

13. Double-wire former according to claim 1 wherein, when viewed in a machine cross direction, the first wire defines a straight line from a point of departure of the first wire from a last deflection roll to a second point at which the first wire begins to define a curved line, said second point is located in an angular sector between a beginning point of a radius $R_{max}$, wherein $R_{max}$ is the largest radius $R_i$, and the first edge of radius $R_1$.

14. Double-wire gap former for the production of a fibrous paper web from a stock suspension, said double-wire former comprising:

a first wire and a second wire, said first and second wires jointly forming a double wire;

a headbox for producing a suspension jet directly between said first and second wires, the suspension jet contacting the second wire at a point of impingement; and first and second convex dewatering elements defining a curved nonrotating perforated surface; said first and second convex dewatering elements being spaced apart and defining a free distance therebetween;

said first dewatering element having a first convex surface in contact with the second wire, said first surface defined by a first arc having a radius $R_1$, wherein $R_1 \leqq 1000$ mm, said first surface beginning at a first edge adjacent the point of impingement, and said radius $R_1$ having a chord height which is greater than or equals one-half the thickness of the suspension jet;

said second convex dewatering element disposed immediately after the first dewatering element in a direction of travel of the first and second wires, the second convex dewatering element having a second convex surface defined by a second arc, said second arc having a second radius of curvature $R_2$, wherein $R_2$>2000 mm.

15. Double-wire former according to claim 14 wherein the free distance between the first and second dewatering elements is maximally 100 mm.

16. Method for producing a fibrous paper web comprising:

providing first and second endless wire loops, wherein the endless wire loops form an entrance gap;

injecting a stock suspension jet from a headbox into the entrance gap between the wire loops and impacting the second endless wire loop at a point of impingement;

dewatering the stock suspension contained between the first and second endless wire loops with at least one dewatering unit thereby forming a fiber web;

the dewatering unit comprising a dewatering element having a first wire-contacted surface with a convex curvature, said surface comprising a plurality of dewatering slats arranged successively;

rotating endless wire loops whereby said wire loops proceed curved and under tension across said first surface from the point of jet impingement, the first wire-contacted surface beginning a first edge adjacent the point of jet impingement, the first wire contacted surface at least two radii of curvature $R_1$ and $R_2$ forming said convex curvature, wherein first $R_1$ defines the first wire contacted surface immediately following the first edge and immediately precedes radius $R_2$ in a direction of travel of the first and second wire loops, first radius $R_1$ is smaller than the radius $R_2$, said radius $R_1$ has a chord height which is than or equals one-half the thickness of the suspension jet, and $R_1 \leqq 1000$ mm.

* * * * *

UNITED STATES PATENT AND TRADEMARK OFFICE

CERTIFICATE OF CORRECTION

PATENT NO. : 5,667,640

DATED : September 16, 1997

INVENTOR(S) : Wilhelm Wanke

It is certified that error appears in the above-indentified patent and that said Letters Patent is hereby corrected as shown below:

Claim 1, column 5, line 6, delete "nontotaling" and substitute therefor --nonrotating--;

column 5, line 9, delete "beg" and substitute therefor --beginning--;

column 5, line 15, delete "$R_i$ $R_i$" and substitute therefor --$R_i < R_{i+1}$--.

Claim 14, column 6, line 24, delete "$R_1 \leq 1000$ mm" to --$R_1 < 1000$ mm--.

Claim 16, column 6, line 53, after "rotating" insert --said--;

column 6, line 56, before "a" insert --at--;

column 6, 58, after "surface" insert --having--;

column 6, line 59, after "first" insert --radius--;

column 6, line 63, before "first" insert --the--;

column 6, line 64, before "than" insert --greater--.

Signed and Sealed this

Eleventh Day of August 1998

Bruce Lehman

*Attest:*

BRUCE LEHMAN

*Attesting Officer*

*Commissioner of Patents and Trademarks*